United States Patent [19]

Graybeal

[11] Patent Number: 4,512,492

[45] Date of Patent: Apr. 23, 1985

[54] MANHOLE CLOSURE WITH A SINGLE LIQUID IMPERVIOUS, TWO-WAY GAS PRESSURE RELIEF VALVE

[76] Inventor: Walter C. Graybeal, 6791 Sheridan St., Hollywood, Fla. 33024

[21] Appl. No.: 560,382

[22] Filed: Dec. 12, 1983

[51] Int. Cl.[3] ..... B65D 51/16

[52] U.S. Cl. ..... 220/204; 404/25

[58] Field of Search ..... 220/203, 204; 404/25; 52/20, 21

[56] References Cited

U.S. PATENT DOCUMENTS 2,089,251 8/1937 DeFrees ..... 220/204

4,030,851 6/1977 Graybeal ..... 404/25

*Primary Examiner*—George T. Hall

*Attorney, Agent, or Firm*—Barry L. Haley

[57] ABSTRACT

A liquid impervious closure for a sewer system manhole opening having a single bi-directional pneumatic breather valve that allows for pneumatic pressure equalization on either side of said closure. The closure is comprised of a pan-shaped barrier and the breather valve mounted there through, said valve having a housing of threadably joined casings enclosing a single moveable sealing plug that engages a gasket to prevent liquid flow in one direction while permitting air flow in either direction.

5 Claims, 7 Drawing Figures

MANHOLE CLOSURE WITH A SINGLE LIQUID IMPERVIOUS, TWO-WAY GAS PRESSURE RELIEF VALVE

BACKGROUND OF THE INVENTION

This invention relates generally to a closure that diverts and prevents surface runoff or other liquids from entering a sewer system through the manhole opening, while permitting pressure equalization at all times between the sewer system pressure and atmospheric pressure. The advantages of such a closure are fully described in applicant's previously issued U.S. Pat. No. 4,030,851 issued June 21, 1977.

Heretofore in order to achieve and ensure bi-directional gas pressure equalization, i.e. relieving excess pressure in the sewer system to the atmosphere or supplying air from the atmosphere if sewer system pressure drops below atmospheric pressure, closures with either two individual (oppositely directional) pneumatic valves or a single valve with multiple moveable elements were employed. This practice increases manufacturing costs and reduces reliability.

The present invention overcomes problems of the prior art by providing a closure having one pneumatic valve with a single moveable valve element that can be efficiently manufactured and installed at lower cost while increasing system reliability.

BRIEF SUMMARY OF THE INVENTION

A closure for a sewer system manhole opening to prevent liquids such as surface runoff or chemicals from entering into the sewer system. The closure is mounted beneath a conventional manhole cover, and includes a breather valve that permits gases to flow in either direction through the closure to effect pressure equalization while preventing liquid flow into the sewer system.

The closure is comprised of a sturdy, water-impervious barrier shaped like a shallow, concave pan having a pneumatic breather valve affixed therethrough. The external rim of the pan includes an outwardly extending, circular lip that securely supports the closure in the manhole opening beneath the manhole cover.

The breather valve is mounted through an aperture in the pan in such a way that no liquid leaks around the pan-valve connection.

The pneumatic relief valve is comprised of a housing having upper and lower casings that are threadably joined together and a single, moveable water sealing plug that permits gas flow in either direction through the valve housing but prevents liquid flow in one direction (into the sewer system). The plug body is cylindrical with one closed end face. A plug guide stem is axially disposed, affixed inside to the closed end face wall, and extends beyond the open end. The guide stem is moveably mounted in a central aperture in the lower valve casing. The end surface of the plug open end supports the plug body on a gasket firmly mounted on the inside bottom face of the lower casing. The weight of the plug body holds the plug against the gasket.

The upper and lower casings of the valve housing have apertures to permit pneumatic flow through each casing. The upper casing has a central aperture that is conical in shape to create a vortex in any liquid collected in the pan. The lower casing has a plurality of apertures disposed within the perimeter of the sealing gasket.

The valve operates as follows. The weight of the plug (and of water collected in the pan) holds the plug body end surface against the sealing gasket preventing water collected in the pan from passing through the pan. This would be the normal condition when the sewer system is at atmospheric pressure.

If the gas pressure increases in the sewer system above atmospheric pressure, the increased internal pressure will lift the plug vertically to allow gas to be vented through the valve housing to the atmosphere. Once pressure is equalized, the plug will drop by its weight to the sealed position.

If the gas pressure in the sewer system drops below atmospheric pressure, air is received into the sewer system because the seal formed between the plug body and gasket is not tight enough to withstand the air pressure differential across the valve. The plug weight (on the gasket) is selected so as to be sufficient to inhibit water flow but not gas flow.

Both the upper and lower valve casings have external flanges that engage opposite sides of the pan near the pan rim aperture, and with the threadable connectors in each casing allow the valve housing to be easily installed and tightly joined to the pan. A liquid sealing compound may also be employed between the valve housing and the pan to prevent leakage.

In operation, the closure is installed over the manhole opening, beneath a conventional manhole cover which acts to hold the closure in position. Surface runoff or chemicals that flow through the manhole cover will be trapped in the closure pan and thus diverted from the sewer system. Any gaseous pressure differential between the sewer system and the atmosphere will be relieved because of the action of the seal plug in the valve.

It is an object of this invention to provide a low cost, non-complex closure for a manhole opening to prevent surface runoff liquid entry into the sewer system while providing two way gas pressure equalization between the atmosphere and the sewer system with one valve having a single, moveable element.

It is another object of this invention to provide a manhole opening closure that includes a single, easily installed, low cost bi-directional gas pressure breather valve that prevents liquid flow in one direction (into the sewer system).

And yet another object of this invention is to provide a closure for a manhole opening that eliminates the need for two separate gas pressure relief valves, each operable in opposite directions.

In accordance with these and other objects which will be apparent hereinafter, the instant invention will now be described with particular reference to the accompanying drawings.

BEST MODE OF CARRYING OUT THE INVENTION

Figure 1:
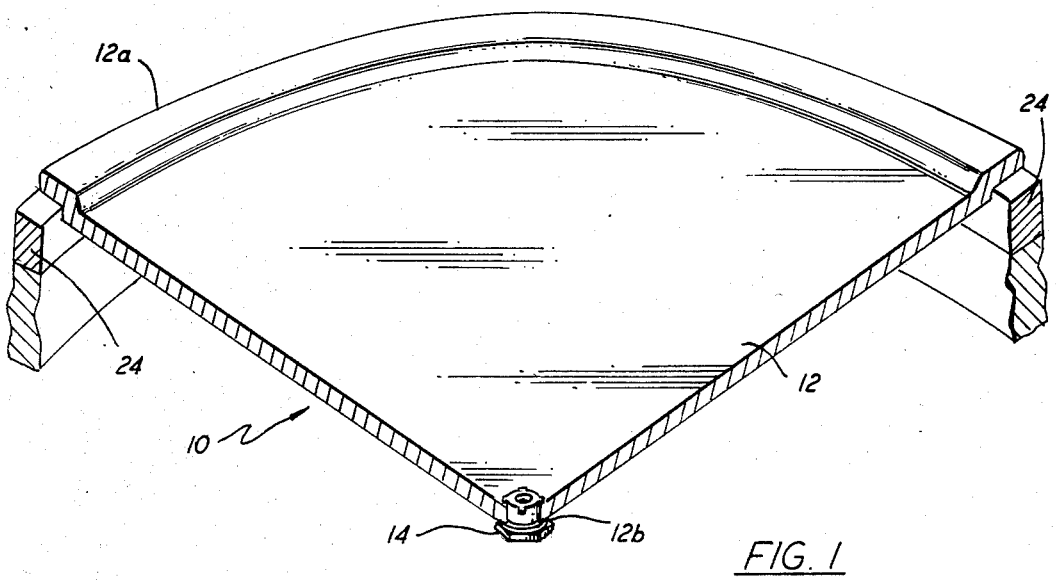
FIG. 1 shows a perspective view of the invention, partially cut away.

Referring now to the drawings and specifically FIG. 1, the closure, in accordance with the invention, is shown generally at 10 comprised of a liquid impervious barrier pan 2 having a pneumatically actuated breather valve 14 that does not permit liquid flow from the upper side of pan 12 into the manhole opening and hence the sewer system.

The barrier pan 12 includes an annular outwardly extending lip 12*a* that is used to mount the closure 10 over the manhole opening rim 24. A conventional manhole cover (not shown) is placed over the closure 10.

Figure 2:
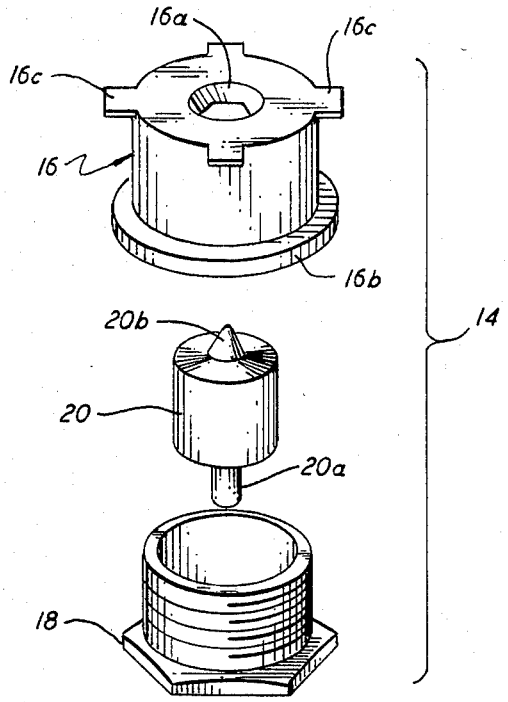
FIG. 2 shows an exploded view of the breather valve employed in the invention.
Figure 3:
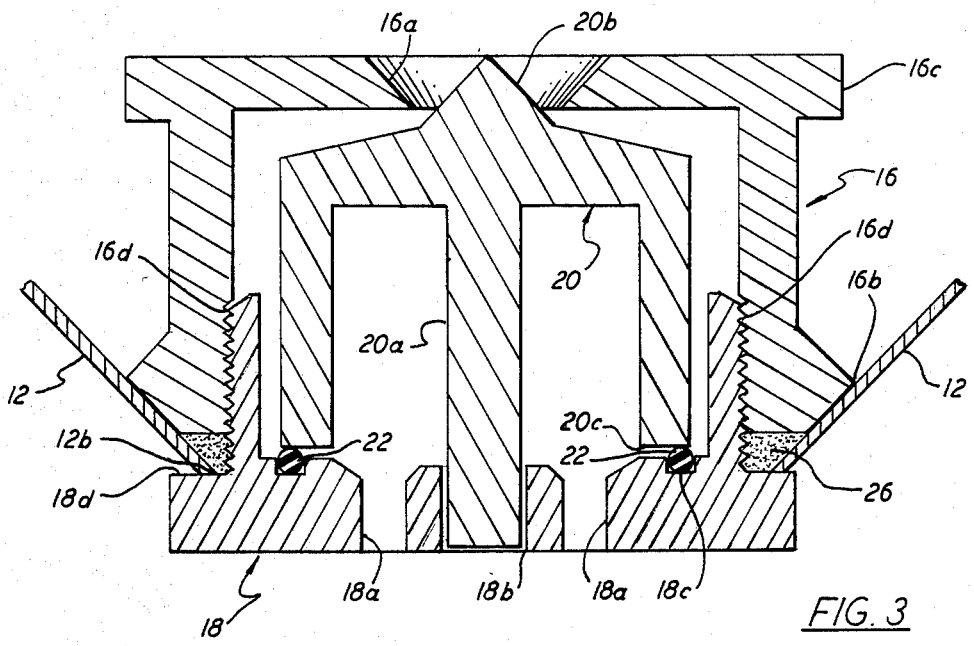
FIG. 3 shows a side elevational view, in cross-section of the breather valve and a segment of the barrier pan at the area of attachment of the valve to the pan.

FIGS. 2 and 3 show the breather valve comprised of an upper casing 16, a liquid sealing plug 20 and lower casing 18.

The wall of upper casing 16 is cylindrical in shape with an end face having a truncated, conical, centrally disposed aperture 16*a*. The smaller end opening in aperture 16*a* may be hexagonal in shape to receive a tool for tightening the upper casing 16 to the lower casing 18. The upper casing exterior also includes a tapered annular flange 16*b* that is shaped to engage a portion of pan 12 near and around the central opening 12*b* in pan 12 to ensure a water tight seal around the opening 12*b*. Lugs 16*c* extend radially outwardly beyond wall 16 to aid in manually grasping of the closure or for rotating of the upper casing 16 during installation or removal of the entire valve 14 from the pan. Inside threads 16*d* provide for attachment to lower casing 18.

The lower casing 18 has a cylindrically-shaped wall with exterior threads that engage the inside threads 16*d* of upper casing 16 and a plurality of apertures 18*a* disposed about a central aperture 18*b* that receives the guide stem 20*a* of sealing plug 20. The lower casing includes a circular groove 18*c* disposed around the outside of apertures 18*a* that receives and holds in place an "O-ring" gasket 22 made of a suitable rubber or rubber-like material. The closed end face of lower casing 18 is hexagonal in exterior shape (to engage a wrench for tightening or loosening) and includes a lip 18*d* that engages the rim of opening 12*b* in pan 12. Notice particularly how easily the valve 14 can be assembled and installed in the pan 12 by rotatably tightening the upper casing 16 to the lower casing 18.

A sealing plug 20 is mounted inside the valve housing formed by uniting the upper and lower casings and constitutes the only moving part in the valve 14. The plug 20 is cylindrical in shape with one closed end having a conically shaped apex 20*b* that protrudes partially into upper casing aperture 16*a*. The plug 20 also includes a unitarily formed guide stem 20*a* disposed along the longitudinal axis of the cylindrical plug wall which extends in length beyond the open end face of the plug 20 so that when plug 20 is resting on gasket 22, a segment of the guide stem 20*a* is inside aperture 18*b* of lower casing 18.

A sealing compound 26 may also be employed during installation of the breather valve 14 to enhance the water tight seal around the pan opening 12*b*.

FIG. 3 is used to describe the operation of the valve 14. In the position of the water sealing plug 20 as shown in FIG. 3, any water in pan 20 will be prevented from passing through the valve 14 (from upper casing 16 to lower casing 18) because of the sealing action of plug 20 resting by its weight against gasket 22.

If the pneumatic pressure in the sewer system increases to a value above atmospheric pressure, then increased gas pressure through apertures 18*a* in lower casing 18 will force plug 20 to lift vertically, allowing gas to escape between the plug wall and gasket 22.

If the gas pressure in the sewer system decreases below atmospheric (usually due to receding liquid levels in the sewer system), the seal formed by plug wall 20*c* and gasket 22 is not sufficient to prevent air forced by atmospheric pressure in the upper casing 16 from leaking into and through lower housing 18. Thus the breather valve 14 can function to relieve pneumatic pressure in either direction through the valve housing while preventing liquid flow in one direction by selecting the plug weight (and resultant gasket contact pressure) to ensure these results.

Figure 4:
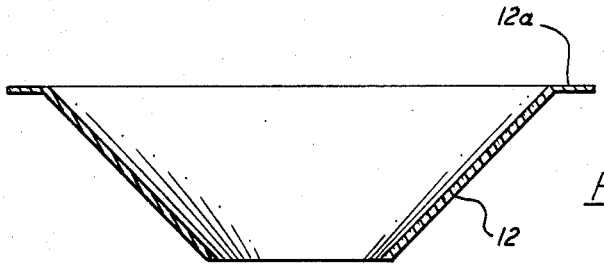
FIG. 4 shows a side elevational view of the barrier pan without the breather valve.

FIG. 4 shows the configuration of the barrier pan 12. The shallowness or depth of the pan is not considered critical to the operation of the invention as long as the closure 10 fits snuggly over the manhole opening. The barrier pan 12 can be constructed from any suitable water impervious, noncorrosive material such as plastic, fiberglass or stainless steel.

Figure 5:
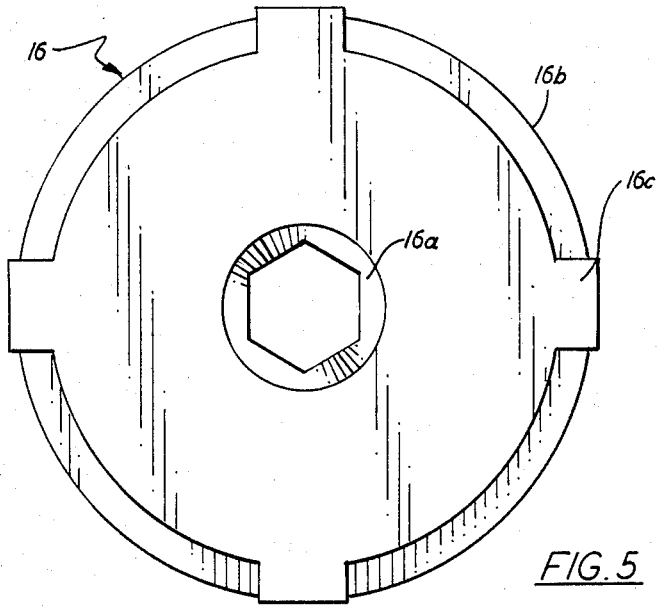
FIG. 5 shows a top plan view of the upper casing of the breather valve.
Figure 6:
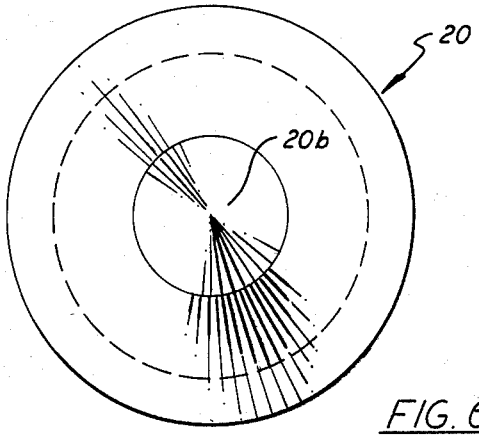
FIG. 6 shows a top plan view of the sealing plug.
Figure 7:
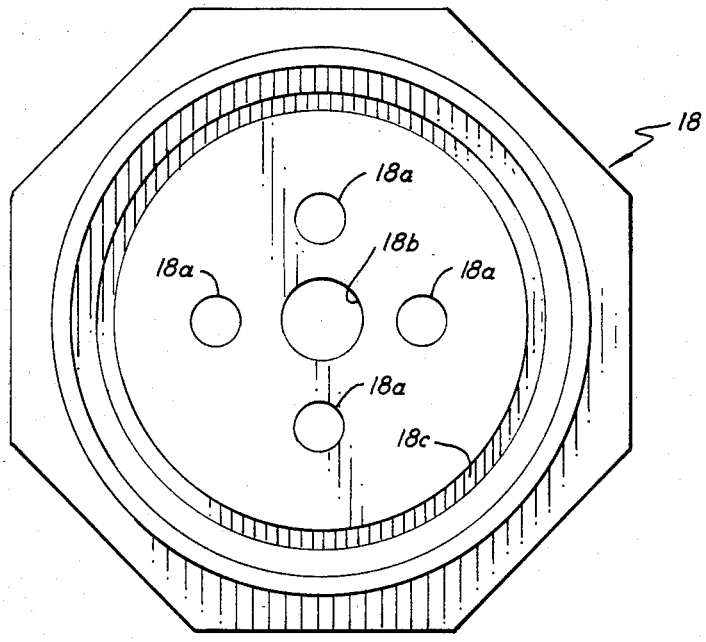
FIG. 7 shows a top plan view of the lower casing of the breather valve and sealing gasket connected therein.

FIGS. 5, 6, and 7 show various views of the upper casing, sealing plug, and lower casing of the breather valve 14.

As has been described above, the closure 10 having only one valve 14 with a single moveable element can prevent any surface liquids from being received into a sewer system while allowing bidirectional pneumatic pressure relief, eliminating the need for two individual pressure relief valves.

What I claim is:

1. A manhole closure to prevent surface liquids from entering a sewer system comprising:

a water impervious barrier, said barrier including a lip disposed circumferentially for supporting the closure around the perimeter of the manhole opening and an aperture;

a pneumatic, bidirectional pressure relief valve mounted within said barrier aperture, said valve having an upper casing and a lower casing joined together to form a valve housing, said upper casing having at least one aperture, and said lower casing having at least first and second apertures; said valve further including a single moveable plug having a predetermined sealing weight mounted in said valve housing, said plug having a body and a guide stem, said stem being disposed in said first aperture of said lower casing, said plug having a cylindrical body with a closed end face, the inside closed end face being coupled to one end of the stem; and a water sealing gasket mounted on the upper surface of the lower casing encircling said first and second apertures on said lower casing, the open end face surface of the plug body engaging the sealing ring to prevent water flow from the upper casing to the lower casing, the weight of the plug being determined to permit air flow through the valve housing in either direction caused by an air pressure differential existing between the upper and lower valve casing apertures.

2. A manhole closure as in claim 1, wherein:

the valve upper casing aperture is centrally disposed and conically shaped to form a fluid vortex above said valve.

3. A manhole closure as in claim 1, wherein:

the upper and lower valve casings are threadably engaged to permit installation or removal from said closure barrier.

4. A manhole closure as in claim 1, wherein:

the upper surface of the plug body includes a raised conically shaped portion that is receivable into the upper valve casing aperture.

5. A manhole closure as in claim 3, wherein:

said upper casing exterior housing has a support flange that engages a portion of the barrier pan near the rim of the barrier pan aperture forming a water-tight seal around the barrier pan aperture and the upper casing of the valve.

* * * * *